United States Patent [19]

Dussia

[11] 4,076,237

[45] Feb. 28, 1978

[54] SPRING TYPE BACK TRACTION EXERCISER

[76] Inventor: Melvin A. Dussia, 7511 N. 47th Ave., Glendale, Ariz. 85301

[21] Appl. No.: 779,502

[22] Filed: Mar. 21, 1977

[51] Int. Cl.[2] ..... A63B 21/04

[52] U.S. Cl. ..... 272/136; 272/DIG. 4

[58] Field of Search ..... 272/136, 135, 142, 144, 272/116, 138, DIG. 4; 297/285, 287; 128/25 R, 25 B, 33

[56] References Cited

U.S. PATENT DOCUMENTS

| | | | |
|---|---|---|---|
| 1,721,709 | 7/1929 | Odell | 272/144 |
| 1,902,694 | 3/1933 | Edwards | 272/144 X |
| 2,968,337 | 1/1961 | Bartlett | 272/52 X |
| 3,462,113 | 8/1969 | MacLeod | 272/52 X |
| 3,558,131 | 1/1971 | Dragon | 272/142 X |

*Primary Examiner*—Richard C. Pinkham
*Assistant Examiner*—William R. Browne
*Attorney, Agent, or Firm*—Cahill, Sutton & Thomas

[57] ABSTRACT

A back traction exercising apparatus is positionable above a flat surface for applying a traction force to the vertebrae of an individual's lower spine as the individual performs exercises on the apparatus and thereby also strengthens selected muscles of his body. The apparatus includes a frame which is positioned adjacent to the flat surface. An armholding peg is attached to and extends vertically from each of the separate arms of the frame to maintain the upper torso of the individual's body in a fixed position with respect to the flat surface as the individual exercises. A spring and bracket assembly is coupled to the apex of the frame and is designed to contact the body of the individual utilizing the apparatus in the area where his legs join his lower torso. The bracket and spring assembly opposes upward movement of the individual's pelvic region as his knees are moved toward his chest and also applies the traction force to the individual's lower spine as he performs exercises on the apparatus.

11 Claims, 6 Drawing Figures

SPRING TYPE BACK TRACTION EXERCISER

BACKGROUND OF THE INVENTION

1. Field of the Invention

This invention relates to exercising apparatus, and more particularly, to an exercising apparatus which is capable of applying a traction force to the vertebrae of an individual's lower spine.

2. Description of the Prior Art

Pain or discomfort in the lower spinal region is a common human affliction. A remedy for lower back pain often prescribed by orthopedic surgeons includes a series of exercises designed to apply a mild traction force to the lower spinal region of the body. These exercises typically include having an individual recline on a floor and rotate his knees up toward his chest region and maintain that position for several seconds. This type of exercise succeeds in applying a moderate amount of traction to the lower spinal region, but is substantially limited in its effectiveness.

For more severe lower back pain, an individual is frequently hospitalized and placed in traction. Traction is applied to the individual's lower spinal region by positioning the individual in a specially designed bed which includes an elevated framework and a complicated series of pulleys and weights. The neck or shoulder region of the individual is attached to a harness which is directly coupled to one end of the bed. A second pair of harnesses are attached to the ankle region of each of the individual's legs and traction is applied as a result of the stretching force caused by the weights pulling against the harness attached to the individual's neck.

The latter method for applying traction to the lower spinal region requires that the individual be totally immobilized for a period of hours each day for a number of days. Not only is this an extremely uncomfortable process, but the expeditures incurred as a result of the hospitalization and the necessary nursing and physician care can run into the thousands of dollars for a single series of treatments. One apparatus of the type described immediately above is disclosed in U.S. Pat. No. 2,768,622 (Sanders). The complexity and expense of this apparatus is clearly evident. It is also evident that an individual desiring to use this type of apparatus requires assistance in being attached to and disconnected from it.

Another type of traction apparatus is disclosed in U.S. Pat. No. 1,950,174 (Harrison). This apparatus is primarily adapted to exercise all of the bodily muscles and is incapable of applying the appropriate type of force to the lower region of the spine. In this apparatus the traction force is applied to each of the outstretched hands and to the ankles of each foot. Idealy, traction should be applied to the lower spinal region by applying opposing forces at the upper torso and in the region where the legs join the lower torso while the lower spinal region is curved inwardly by having the knees elevated toward the chest region. The Harrison apparatus is incapable of providing the appropriate type of forces to accomplish the desired result.

A related type of exercise device is disclosed in U.S. Pat. No. 1,561,979 (Gore). This device is primarily directed to strengthening the leg muscles by attaching a cable coupled to a spring for opposing the upward and inward movement of the legs. An appropriate traction force cannot be applied to the lower back region since no means is provided for retaining the upper torso region in a fixed position when more than an insignificant amount of traction is applied to the lower back region. An attempt to increase the traction force on the individual using this apparatus will cause his body to slide along the bed toward the end of the bed closest to his feet.

Other types of exercising apparatus which are less closely related to the present invention in that they are incapable of applying the appropriate type of traction force to the lower spinal region are disclosed in the following U.S. Pat. Nos. 3,760,801 (Borgeas); 3,876,198 (Seligman); 3,596,654 (Tamura); 3,568,666 (Dunn); 3,315,666 (Sellner); 3,043,591 (Sellner); 42,516 (Taylor); 3,904,195 (Chavanne); and 3,774,597 (Root).

SUMMARY OF THE INVENTION

It is therefore a primary object of the present invention to provide a back traction exerciser which applies a traction force to the vertebrae of an individual's lower spine as the individual performs exercises and thereby also strengthens selected muscles.

Another object of the present invention is to provide a back traction exerciser which exerts a traction force on an individual's lower spine by applying opposing forces to the individual's upper and lower torso regions.

Yet another object of the present invention is to provide a back traction exerciser, the use of which substantially strengthens weak back muscles.

Still another object of the present invention is to provide a back traction exerciser which is light in weight and inexpensive.

A still further object of the present invention is to provide a back traction exerciser which can be collapsed into a relatively small physical size and is therefore readily storable when not in use.

A yet further object of the present invention is to provide a back traction exerciser which is readily adjusted to be used by individuals of different size and strength.

Briefly stated, and in accord with one embodiment of the invention, a back traction exercising apparatus which is positionable above a flat surface is disclosed for applying a traction force to the vertebrae of an individual's lower spine as the individual performs exercises on the apparatus and thereby also strengthens selected muscles of his body. The back traction apparatus includes a frame positioned adjacent the flat surface and includes first and second end sections. Body retention means is coupled to the first end section of the frame for maintaining the upper torso of the individual's body in a fixed position with respect to the flat surface as the individual exercises. Spring means is coupled to the second end section of the frame and contacts the body of the individual utilizing the apparatus in the area where his legs join his lower torso for opposing upward movement of his pelvic region as his knees are moved upward toward his chest and for applying the traction force to the lower spine as the individual performs exercises on the apparatus. In this manner the traction force is applied to the lower vertebrae of the individual's spine by the opposing forces exerted on his torso by the body retention means and the spring means.

DESCRIPTION OF THE DRAWING

The invention is pointed out with particularity in the appended claims. However, other objects and advantages, together with the operation of the invention may be better understood by reference to the following detailed description taken in connection with the following illustrations wherein:

DESCRIPTION OF THE PREFERRED EMBODIMENT

In order to better illustrate the advantages of the invention and its contributions to the art, a preferred hardware embodiment of the invention will now be described in some detail.

Figure 1:
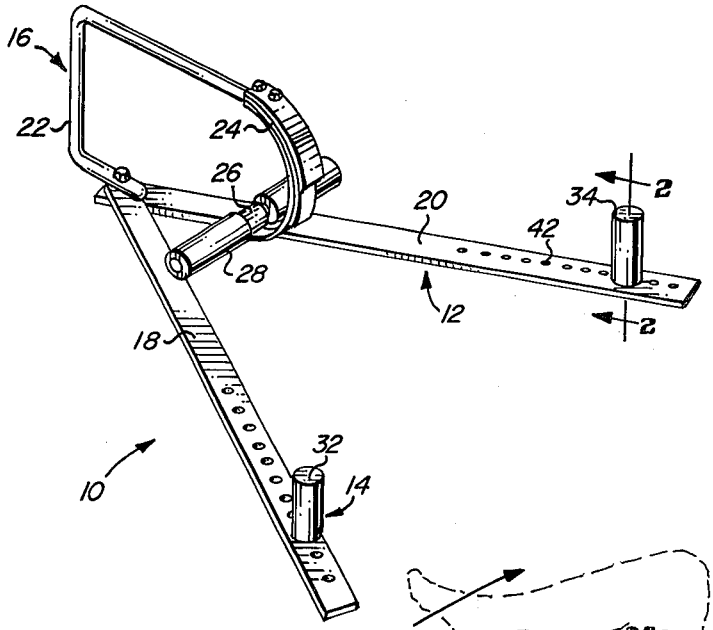
FIG. 1 is a perspective view of one embodiment of the back traction exerciser of the present invention.

Referring now to FIG. 1, back traction exerciser 10 includes a frame 12, arm holding pegs or body retention means 14 coupled to the first end section of frame 12, and spring means 16. The frame is typically positioned above a flat surface such as a floor or a rug and includes a first arm 18 and a second arm 20. In the presently preferred embodiment frame 12 is configured in a vee shape with arms 18 and 20 being coupled together by a bolt at the apex of the vee-shaped frame.

Spring means 16 includes a bracket means 22, a length of spring-like material 24 and a pad means 26. Bracket 22 is coupled to the apex of the vee formed by arms 18 and 20 of frame 12. The apex of frame 12 will also be referred to as the second end section of frame 12.

Figure 3:
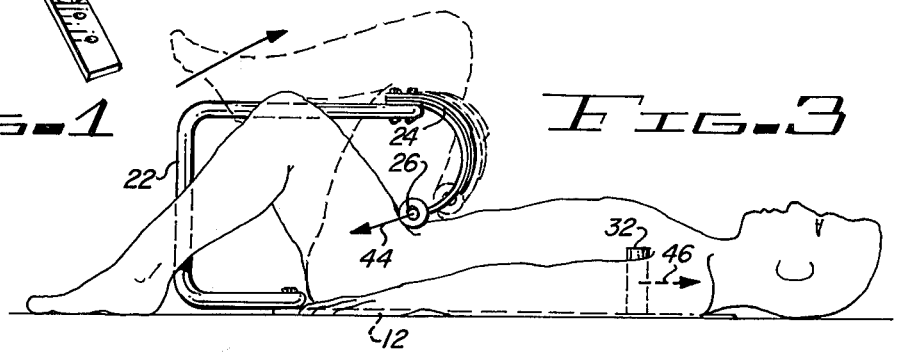
FIG. 3 is an elevational view of the back traction exerciser illustrated in FIG. 1, further illustrating an individual in the process of performing exercises thereon.

Referring now to FIGS. 1 and 3, one end of the curved leaf spring 24 is coupled to bracket 22 while the other end of spring 24 is coupled to cylindrical rod 26. Two hollow cylindrical sections of foam rubber padding 28 are positioned about rod 26 to pad the interface between rod 26 and the lower torso region of the user's body.

Figure 2:
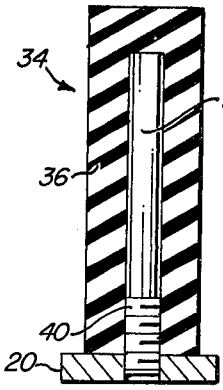
FIG. 2 is a sectional view of the vertically extending peg shown in FIG. 1, taken along section line 2—2.

Referring now to FIGS. 1 and 2, body retention means 14 consists of a first peg 32 and a second peg 34. A padded cylindrical outer section 36 surrounds a metalic shaft 38 having a threaded end portion 40. Peg 34 is secured to arm 20 by screwing the exposed threaded portion 40 into one of the threaded apertures, such as aperture 42, in arm 20. The plurality of apertures in each arm in conjunction with the threaded end portions of the pegs provide a means for adjustably positioning the pegs at variable positions along the arms. In this manner the back traction exerciser can be adjusted to accommodate bodies of various dimensions.

Figure 5:
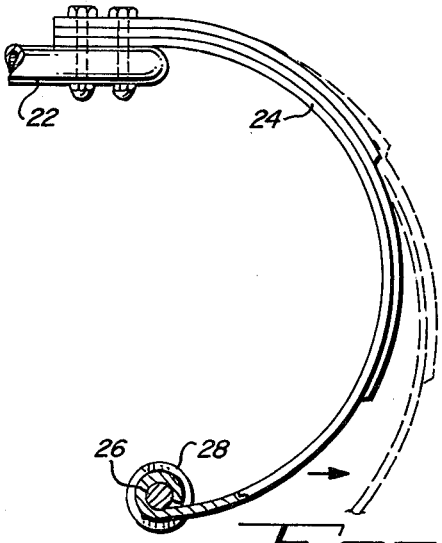
FIG. 5 is a more detailed view of the spring means of the back traction exerciser, more particularly pointing out the deformation of the spring with exercise.
Figure 6:
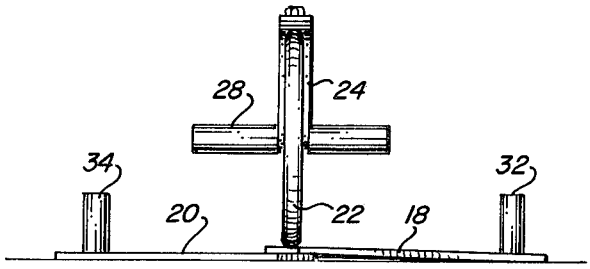
FIG. 6 is an endwise view from the left side of the back traction exerciser illustrated in FIG. 1.

Referring now to FIG. 5, spring element 24 can include either one or a plurality of curved leaf springs. In the embodiment shown the inner element of spring 24 forms a semi-circle and includes a curved end portion which surrounds rod 26 to provide a coupling therebetween. The opposite end of the spring element is coupled to bracket 22 by a pair of bolts which are secured by a pair of nuts. A second intermediate length of spring steel and a third short length of spring steel can be added as desired to increase the overall resistance to movement of the spring element 24. As the back muscles are strengthened, the additional spring elements can be added to increase the difficulty of performing exercises and to increase the traction force supplied to the lower vertebrae of the spine. The dotted lines of FIG. 5 illustrate the displacement of spring 24 during exercise.

Figure 4:
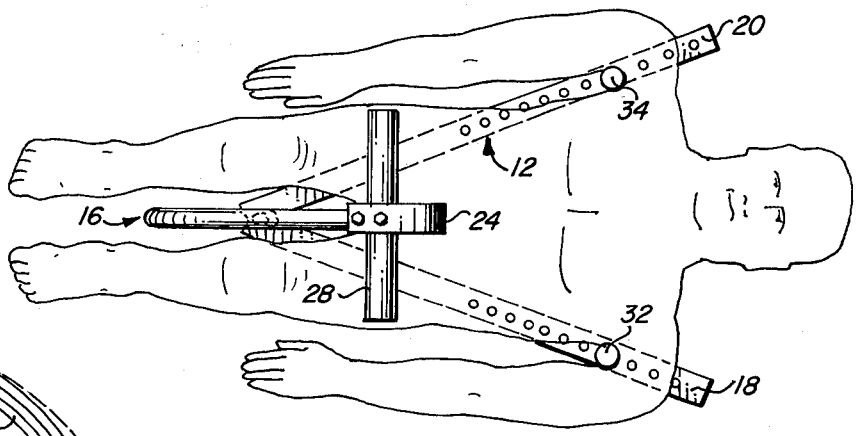
FIG. 4 is a plan view from above of the individual using the back traction exerciser shown in FIG. 3.

Referring now to FIGS. 3 and 4, the manner of using the back traction exerciser will now be set forth. Prior to using the exerciser an individual must adjust the relative angular displacement between arms 18 and 20 and the relative positioning of pegs 32 and 34 of frame 12 so that in the supine position with the apex of frame 12 positioned slightly behind the individual's buttocks, pegs 32 and 34 can comfortably be positioned against the uppermost portion of his armpits. The individual's legs are positioned to stradle bracket 22 and the adjustable features of the back traction exerciser are positioned to permit pad means 26 to comfortably rest along the lower torso region where the legs join the body. The individual's feet are placed flat on the floor with the knees slightly elevated.

To commence exercise the individual raises his knees toward his chest region in the manner shown in FIG. 3. Initially, small excursions of the knees toward the chest will be sufficient, but with time the individual should be able to elevate his knees to a position in contact with his chest. The individual should use his arms to grasp his knees and assist in pulling them toward his chest. The individual should maintain this position with his knees held on contact with his chest region to allow a sustained back traction force to be applied to the lower portion of his spine. This back traction force gently pulls the vertebrae apart and slightly stretches the back muscles in that region.

The force vectors indicated by reference Nos. 44 and 46 indicate that the elevation of the pelvic region of the user's body causes a generally horizontally oriented vector to be applied by spring means 16 to the lower torso region, while an opposite but substantially equal horizontally oriented force vector is applied to the inner armpit regions of the individual by pegs 32 and 34. The individual's spine is the structural element which couples these opposing force vectors together. Relative movement between frame 12 and the flat surface upon which it rests is precluded by the normal force exerted by the weight of the individual's body against the upper surface of the frame which maintains it in frictional contact with the flat surface.

An alternative form of exercise can be accomplished by having the individual assume the initial position as previously discussed with both feet flat on the floor and the knees slightly elevated. In this position the user then forceably pushes bar 26 down and away from his armpit region to effectively apply a traction force to the lower region of his spine. While applying this force with his hands, the individual elevates the lower pelvic region of his body and maintains this position for a few seconds.

Exercising with the back traction exerciser substantially stengthens the lower back muscles and stretches both the vertabrae and the back muscles in the lower spinal region. It has been demonstrated through actual use of this exercising apparatus that back pain can be substantially alleviated after several days.

Upon completion of the exercise sequence, the user of the back traction exerciser can pivot arms 18 and 20 toward each other to collapse the frame so that it can be readily stored. Spring 24 is easily disassembled from bracket 22 by removing the nuts and bolts which attach it thereto. Similarly pegs 32 and 34 can be unscrewed from arms 18 and 20 and stored. When totally disassembled the back traction apparatus occupies an extremely small volume.

It will be apparent to those skilled in the art that the disclosed back traction exerciser may be modified in numerous other ways and may assume many other embodiments other than the preferred form specifically set out and described above. In place of the vee-shaped frame as disclosed above, a U-shaped frame, a T-shaped, or even a rectangular frame could be used to perform an equivalent function. Additionally, in place of the spring steel used in the spring means, a plastic material or any other suitable material having similar spring-like characteristics could be used to provide the required traction force.

In order to facilitate the initial entry of an individual into the back traction exerciser, it might also be highly advantageous to incorporate a swivel-type bracket into the vertically extending element of bracket 22 in order that the upper portion of spring means 16 could be rotated approximately 90 degrees to eliminate the requirement to physically slide beneath cylindrical rod 26 and the frame 12.

Furthermore, in order to eliminate the necessity of threading each of the apertures, such as aperture 42, which receive the threaded end portion 40 of the arm holding pegs, an alternative frame embodiment might be utilized. The alternative frame embodiment 12 would include a plurality of apertures in the first and second arms. These apertures would extend from the apex of the vee of frame 12 outward toward the armholding pegs and none of these apertures would be threaded. The length of each of the frame arms would also be extended so that frame 12 would have an X-shape as opposed to the V-shape of the preferred embodiment discussed above. With this configuration the arm holders 14 would be rigidly attached at a single point on each of the frame elements. To adjust the relative spacing between cylindrical rod 26 and the arm holders 14, a user would disconnect the bolt-nut combination securing bracket 16 to frame 12. Each of the arms of frame 12 would then be repositioned such that the spacing between cylindrical rod 26 and the arm holders 14 would be appropriate for a particular individual's body. When this position has been obtained, the user would then reposition the bolt-nut combination through bracket 16 and through an aperture in each of the frame elements 18 and 20.

Accordingly, it is intended by the appended claims to cover all such modifications of the invention which fall within the true spirit and scope of the invention.

What is claimed is:

1. A back traction exercising apparatus comprising in combination:

(a) a frame positionable on a flat surface and having first and second end sections;

(b) body retention means coupled to the first end section of said frame for maintaining the upper torso of the individual's body in a fixed horizontal position with respect to a flat surface as the individual exercises; and (c) spring means coupled to the second end section of said frame and mounted on only one upwardly extending frame member, and said spring means being of only one single leaf spring extending downwardly so that the terminal end thereof contacts the body of the individual utilizing said apparatus in the area where his legs join his lower torso for opposing upward movement of his pelvic region as his knees are moved upward toward his chest thus causing a substantially constant horizontal traction force to the lower spine as the individual performs exercises on said apparatus;

whereby the traction force is applied to the lower vertebrae of the individual's spine by the opposing forces exerted on his torso by said body retention means and said spring means.

2. The apparatus according to claim 1 wherein said frame further includes first and second arms.

3. The apparatus according to claim 2 wherein said spring means further includes pad means for distributing the traction force applied by said spring means to the lower torso.

4. The apparatus according to claim 3 wherein said spring means further includes bracket means having a first end coupled to the second end section of said frame and a second end.

5. The apparatus according to claim 4 wherein said spring means further includes a length of a spring material having one end coupled to the second end of said bracket means and another end coupled to said pad means.

6. The apparatus according to claim 5 wherein said spring material includes spring steel.

7. The apparatus according to claim 5 wherein said spring material includes plastic.

8. The apparatus according to claim 5 wherein said body retention means includes a first peg extending vertically upward from said first arm and a second peg extending vertically upward from said second arm.

9. The apparatus according to claim 8 further including means for adjustably positioning said first and said second peg at variable positions along said first and said second arms.

10. The apparatus according to claim 9 wherein said frame can be collapsed in size to reduce the size of said apparatus and to permit simplified storage thereof.

11. The apparatus according to claim 9 wherein said pad means includes a cylindrical rod.

* * * * *